US009486059B2

(12) United States Patent
Wechsler et al.

(10) Patent No.: US 9,486,059 B2
(45) Date of Patent: Nov. 8, 2016

(54) ORAL CARE IMPLEMENT

(75) Inventors: Andreas Wechsler, Zell am See (AT); Robert Moskovich, East Brunswick, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 95 days.

(21) Appl. No.: 14/380,996

(22) PCT Filed: Mar. 1, 2012

(86) PCT No.: PCT/US2012/027165

§ 371 (c)(1),
(2), (4) Date: Aug. 26, 2014

(87) PCT Pub. No.: WO2013/130080

PCT Pub. Date: Sep. 6, 2013

(65) Prior Publication Data

US 2015/0040335 A1 Feb. 12, 2015

(51) Int. Cl.
*A46B 9/00* (2006.01)
*A46B 5/00* (2006.01)

(52) U.S. Cl.
CPC ..... *A46B 5/0029* (2013.01); *A46B 5/0041* (2013.01); *A46B 2200/1066* (2013.01)

(58) Field of Classification Search
CPC .. A46B 5/002; A46B 5/0025; A46B 5/0029; A46B 5/0041; A46B 5/0054; A46B 9/04
USPC ..... 15/167.1
See application file for complete search history.

(56) References Cited

U.S. PATENT DOCUMENTS

| | | | |
|---|---|---|---|
| 1,632,859 | A | 6/1927 | Straehly |
| 1,968,303 | A | 7/1934 | McMath |
| 3,398,421 | A | 8/1968 | Rashbaum |

(Continued)

FOREIGN PATENT DOCUMENTS

| | | |
|---|---|---|
| DE | 20109123 U1 | 10/2002 |
| EP | 0930030 | 7/1999 |

(Continued)

OTHER PUBLICATIONS

International Search Report and the Written Opinion issued in International Application PCT/US2012/27165 mailed Jan. 4, 2013 WO.

(Continued)

*Primary Examiner* — Laura C Guidotti

(57) ABSTRACT

An oral care implement (100) having a head (120) that achieves an enhanced cleaning action during brushing. In one embodiment, the invention can be an oral care implement comprising: a handle (110) extending from a proximal end to a distal end; a head comprising: a cantilever (130) extending from the distal end of the handle; a spheroid (160) protruding from a front surface (131) of the cantilever; a rigid plate (140), the rigid plate spaced from the cantilever by a gap (151); and a first resilient material (150) in the gap flexibly coupling the rigid plate to the cantilever, the first resilient material encasing the spheroid and covering a rear surface (142) of the rigid plate and the front surface of the cantilever; a plurality of teeth cleaning elements (143) extending from a front surface of the rigid plate; and the rigid plate pivoting about the spheroid in response to brushing forces being applied to the head.

43 Claims, 7 Drawing Sheets

(56) References Cited

U.S. PATENT DOCUMENTS

| | | | |
|---|---|---|---|
| 4,020,521 | A | 5/1977 | Velasquez |
| 4,403,623 | A | 9/1983 | Mark |
| 4,796,325 | A | 1/1989 | Bortman |
| 5,228,166 | A | 7/1993 | Gomez |
| 5,491,866 | A | 2/1996 | Simonds |
| 5,884,354 | A | 3/1999 | Anderson |
| 5,956,797 | A | 9/1999 | Wilson |
| 5,987,689 | A | 11/1999 | Gordon |
| 6,066,282 | A | 5/2000 | Kramer |
| 6,178,582 | B1 | 1/2001 | Halm |
| 6,408,473 | B1 | 6/2002 | Kessler |
| 6,931,688 | B2 | 8/2005 | Moskovich et al. |
| 7,805,796 | B2 | 10/2010 | Winter et al. |
| 2002/0056197 | A1 | 5/2002 | Johnson |
| 2007/0067933 | A1 | 3/2007 | Waguespack |
| 2007/0283519 | A1 | 12/2007 | Moss |
| 2011/0016651 | A1 | 1/2011 | Piserchio |
| 2011/0271471 | A1 | 11/2011 | Kirsh |

FOREIGN PATENT DOCUMENTS

| | | |
|---|---|---|
| EP | 2135526 | 12/2009 |
| WO | WO 2010/123208 | 10/2010 |
| WO | WO 2012/055423 | 5/2012 |

OTHER PUBLICATIONS

Written Opinion of the International Preliminary Examining Authority issued in International Application PCT/US2012/27165 mailed Feb. 21, 2014. WO.

ORAL CARE IMPLEMENT

CROSS-REFERENCE TO RELATED PATENT APPLICATIONS

The present application is a U.S. national stage entry under 35 U.S.C. §371 of Patent Cooperation Treaty Patent Application No. PCT/US2012/27165, filed Mar. 1, 2012, the entirety of which is incorporated herein by reference.

FIELD OF THE INVENTION

The present invention relates generally to oral care implements, and specifically to oral care implements, such as toothbrushes, having a head that achieves an enhanced cleaning action during brushing.

BACKGROUND OF THE INVENTION

A variety of toothbrush configurations exist that have manually and/or mechanically-driven movable cleaning elements. These toothbrush configurations, however, include cleaning elements that extend from a rigid head. Teeth and gums by nature have a complex intricate contour. Due to the rigid nature of the attachment of the cleaning elements to the head of the toothbrush, the orientation of the cleaning elements is not flexible. Thus, a need exists for a toothbrush that achieves better flexibility of cleaning elements for an improved and enhanced cleaning action during brushing.

BRIEF SUMMARY OF THE INVENTION

The present invention is directed to an oral care implement. In one aspect, the oral care implement can include a handle and a head. The head comprises a cantilever, a pivot structure and a rigid plate spaced from the cantilever by a gap. The rigid plate comprises a plurality of teeth cleaning elements extending therefrom. The gap is filled with a resilient material. Thus, the oral care implement facilitates the rigid plate pivoting about the pivot structure in response to brushing forces being applied to the head.

In one embodiment, the invention can be an oral care implement comprising: a handle extending along a longitudinal axis from a proximal end to a distal end; a head comprising: a cantilever connected to and extending longitudinally from the distal end of the handle; a spheroid protruding from a front surface of the cantilever; a rigid plate having a front surface and a rear surface, the rigid plate positioned above the cantilever so that the rigid plate is spaced from the cantilever by a gap; and a first resilient material in the gap flexibly coupling the rigid plate to the cantilever, the first resilient material encasing the spheroid and covering the rear surface of the plate and the front surface of the cantilever; a plurality of teeth cleaning elements coupled to and extending from the front surface of the rigid plate; and the rigid plate pivoting about the spheroid in response to forces being applied to the head.

In another embodiment, the invention can be an oral care implement comprising: a handle extending along a longitudinal axis from a proximal end to a distal end; a head comprising: a cantilever extending longitudinally from the distal end of the handle; a pivot structure protruding from a front surface of the cantilever; a rigid plate having a front surface and a rear surface, the rigid plate positioned above the cantilever so that the rigid plate is spaced from the cantilever by a gap, the rigid plate extending longitudinally beyond a distal end of the cantilever; and a first resilient material in the gap flexibly coupling the rigid plate to the cantilever, the first resilient material encasing the pivot structure and covering the rear surface of the rigid plate and the front surface of the cantilever; a plurality of teeth cleaning elements coupled to and extending from the front surface of the rigid plate; and the rigid plate pivoting relative to the cantilever about the pivot structure in response to forces being applied to the head.

In a further embodiment, the invention can be an oral care implement comprising: a handle extending along a longitudinal axis from a proximal end to a distal end; a head comprising: a cantilever extending longitudinally from the distal end of the handle and forming a front longitudinal layer of the head; a rigid plate having a front surface and a rear surface, the rigid plate positioned above the cantilever so that the rigid plate is spaced from the cantilever by a gap, the rigid plate forming a rear longitudinal layer of the head; and a first resilient material in the gap flexibly coupling the rigid plate to the cantilever, the resilient material covering the rear surface of the rigid plate and a front surface of the cantilever, the first resilient material forming a middle longitudinal layer between the front and rear longitudinal layers; a plurality of teeth cleaning elements coupled to and extending from the front surface of the rigid plate.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
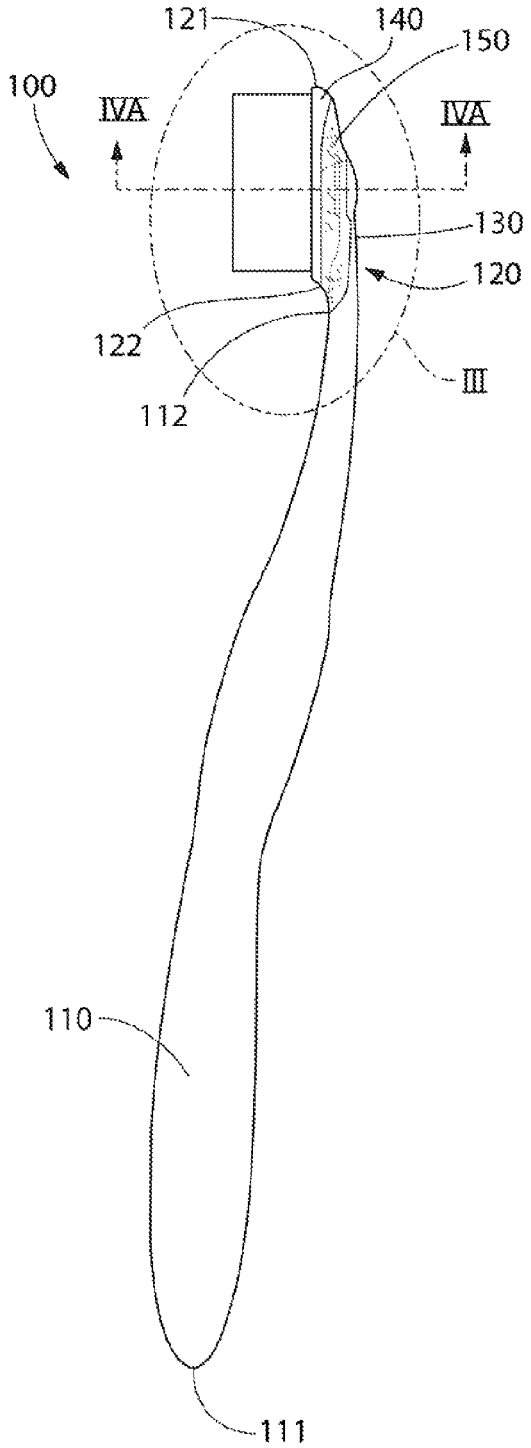
FIG. 1 is a side view of an oral care implement in accordance with a first embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of the exemplary embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the exemplary embodiments illustrated herein. Accordingly, the invention expressly should not be limited to such exemplary embodiments, even if indicated as being preferred. The discussion herein describes and illustrates some possible non-limiting combinations of features that may exist alone or in other combinations of features. The scope of the invention is defined by the claims appended hereto.

Figure 2:
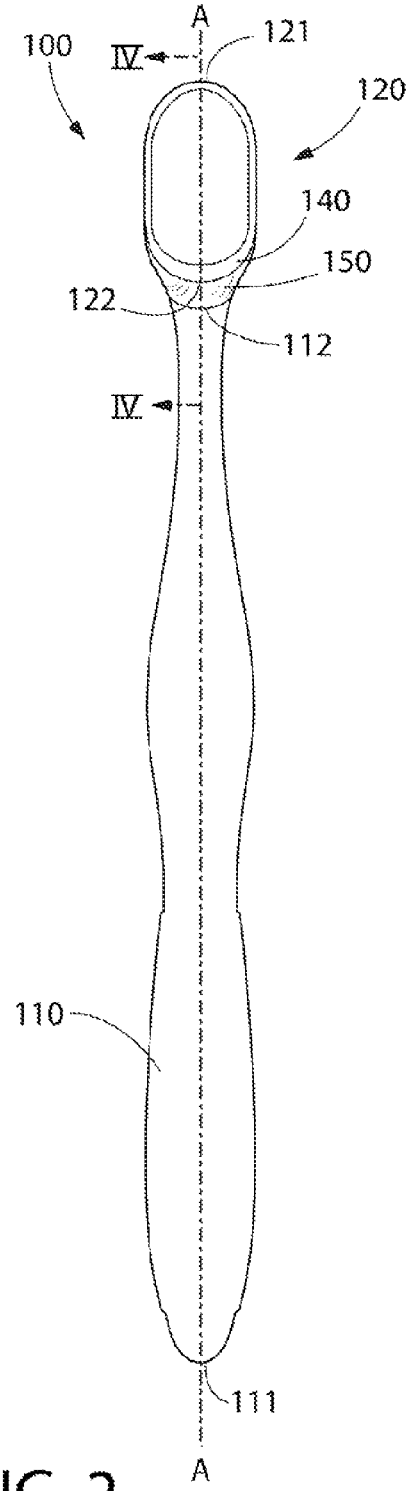
FIG. 2 is a front view of the oral care implement of FIG. 1.

Referring to FIGS. 1 and 2 concurrently, an oral care implement 100 in accordance with an embodiment of the present invention will be described. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleaner, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement 100 generally comprises a handle 110 and a head 120. The handle 110 extends along a longitudinal axis A-A from a proximal end 111 to a distal end 112. The handle 110 is an elongated structure that provides the mechanism by which the user can hold and manipulate the oral care implement 100 during use. The handle 110 can take on a wide variety of shapes, contours and configurations, none of which are limiting of the present invention. In the exemplified embodiment, the handle 110 is formed of a hard plastic material, such as for example without limitation polypropylene, polymers and copolymers of ethylene, propylene, butadiene, vinyl compounds and polyesters such as polyethylene terephthalate. Of course, the invention is not to be so limited in all embodiments and the handle 110 may be formed with a resilient material, such as a thermoplastic elastomer, over portions of or the entirety of the handle 110 to enhance the gripability of the handle 110 during use.

The head 120 extends from a proximal edge 122 to a distal edge 121. Furthermore, the head 120 of the oral care implement 100 generally comprises a cantilever 130, a rigid plate 140 and a resilient material 150. The cantilever 130 is connected to and extends from the distal end 112 of the handle 110. The cantilever 130 is formed of a rigid material, such as a hard plastic material. Specifically, in the exemplified embodiment the cantilever 130 is formed integrally with the handle 110 and of the same material as the handle 110. However, the invention is not to be so limited in all embodiments and in certain other embodiments the cantilever 130 can be separately formed from the handle 110 and connected to the handle at a later stage of the manufacturing process by any suitable technique known in the art, including without limitation thermal or ultrasonic welding, a tight-fit assembly, a coupling sleeve, threaded engagement, adhesion, or fasteners.

Furthermore, the rigid plate 140 is also formed of a rigid material, such as one of the hard plastic materials listed above with regard to the handle 110 and the cantilever 130. However, as will be discussed in more detail below, the rigid plate 140 is separated from and not directly connected to either the cantilever 130 or the handle 110. Thus, the rigid plate 140 (and the rigid material that forms the rigid plate 140) is isolated from both the handle 110 and the cantilever 130 such that the rigid plate 140 forms a free floating bristle support plate of the oral care implement 100. Attachment of the rigid plate 140 to the cantilever 130 is achieved via the first resilient material 150 as will be discussed below. Creating the oral care implement 100 in this manner enables the rigid plate 140 to be capable of 360 degree pivotal movement as will be described in more detail below with reference to FIGS. 5A-5D.

Although the rigid plate 140, the handle 110 and the cantilever 130 are described herein as being formed of a rigid material, the rigid material is not limited to being a completely stiff and inflexible material in all embodiments. Rather, the term rigid is used herein to describe the material of the rigid plate 140, the handle 110 and the cantilever 130 relative to the resilient material 150. Thus, in certain embodiments the rigid plate 140, the handle 110 and the cantilever 130 may be capable of a certain degree of flexure and movement, but are firmer or harder than the resilient material 150 to facilitate the pivoting movement of the rigid plate 140 as will be described in more detail below.

Figure 3:
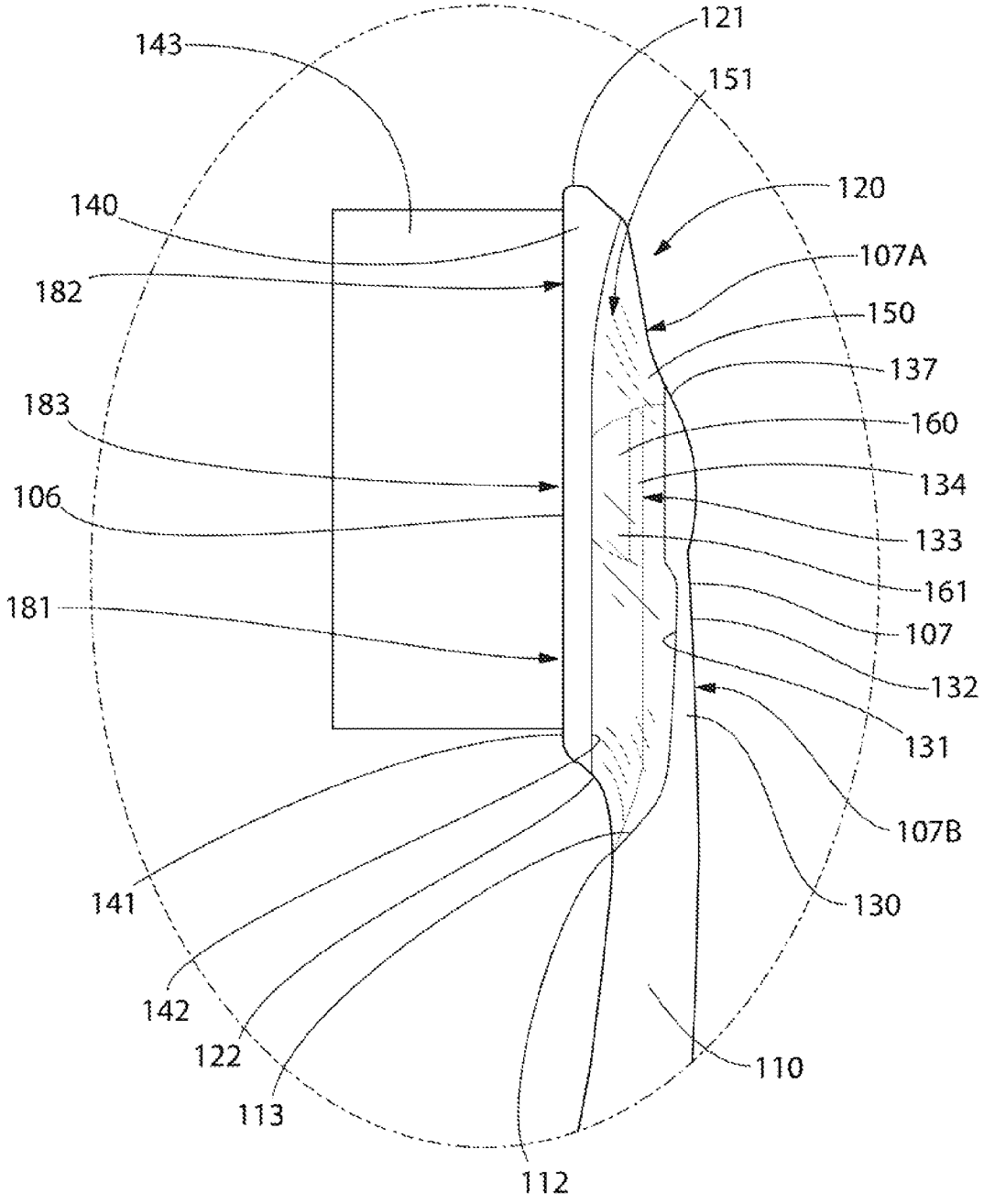
FIG. 3 is a close-up view of area III of FIG. 1.
Figure 4:
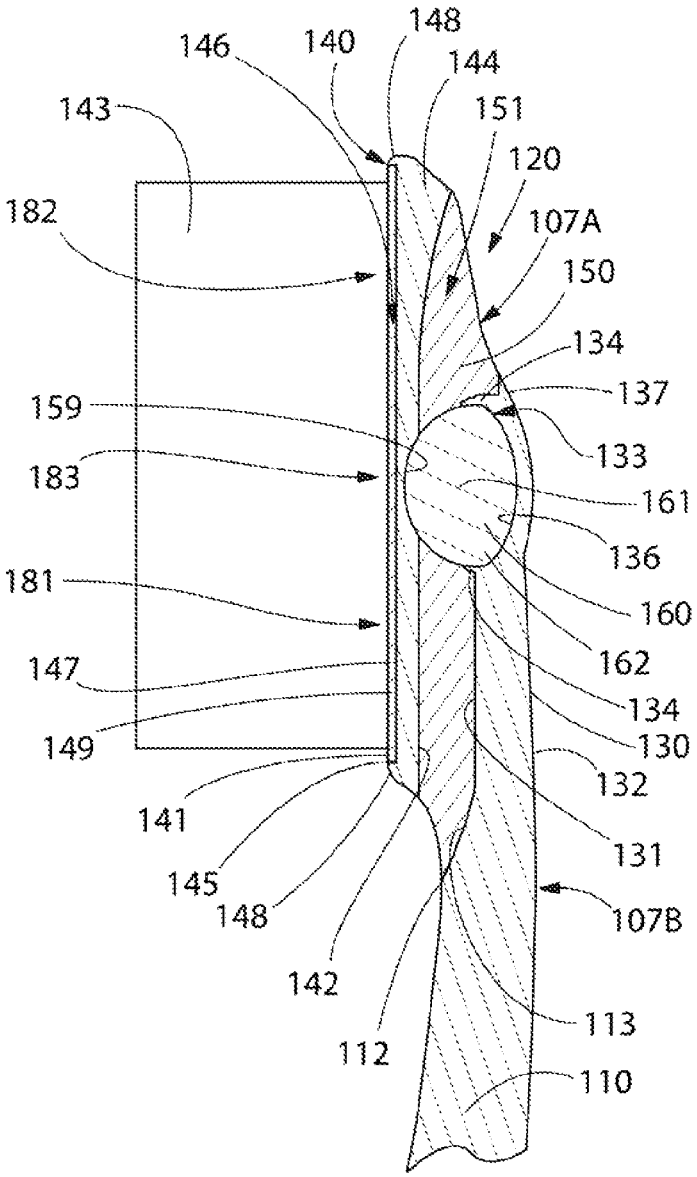
FIG. 4 is a cross-sectional view taken along line IV-IV of FIG. 2.
Figure 4A:
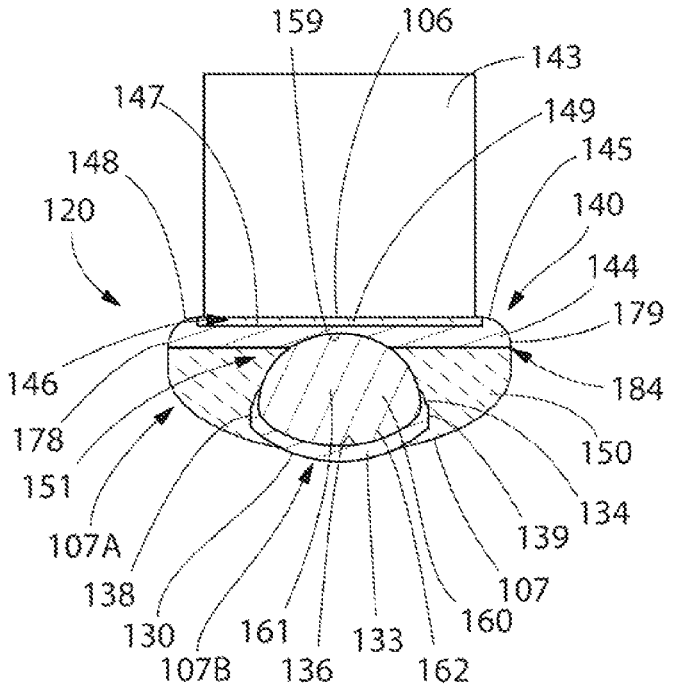
FIG. 4A is a cross-sectional view taken along line IVA-IVA of FIG. 1.

Referring now to FIGS. 3-4A concurrently, the oral care implement 100 will be described in more detail. The rigid plate 140 extends from the distal edge 121 of the head 120 to the proximal edge 122 of the head. Furthermore, the rigid plate 140 comprises a peripheral edge 184 that forms a peripheral edge of the head 120. The rigid plate 140 comprises a front surface 141 and an opposing rear surface 142. A plurality of tooth cleaning elements 143 are coupled to and extend outwardly from the front surface 141 of the rigid plate 140. In the exemplified embodiment, the tooth cleaning elements 143 are generically illustrated. The exact number, size and configuration of the tooth cleaning elements 143 are not to be limiting of the present invention unless so specified in the claims. The tooth cleaning elements 143 can be particularly suited for brushing teeth, or can be particularly suited to polish teeth instead of or in addition to cleaning teeth.

As used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 143 of the present invention can be connected to the head 120 in any manner known in the art. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

The rigid plate 140 generally comprises a base plate 144 having a front surface 145 and a rear surface. The rear surface of the base plate 144 is coextensive with the rear surface 142 of the rigid plate 140. The front surface 145 of the base plate 144 has a basin 146 formed therein. The basin 146 is formed by an upstanding wall 148 that extends upwardly from a floor 147 of the basin 146. Furthermore, the rigid plate 140 also comprises a head plate 149 that is positioned in the basin 146. The head plate 149 nests within the basin 146 such that a front surface of the head plate 149 is coextensive and flush with the front surface 145 of the base plate 144 to thereby form an even and flush front surface of the head 120 of the oral care implement 100. The plurality of tooth cleaning elements 143 are connected to and extend upwardly from the head plate 149 of the rigid plate 140.

Still referring to FIGS. 3-4A, as noted above the cantilever 130 extends from the distal end 112 of the handle 110. More specifically, the distal end 112 of the handle 110 comprises a transverse shoulder 113, and the cantilever 130 extends longitudinally from the transverse shoulder 113. The cantilever 130 comprises a front surface 131 and an opposing rear surface 132. The rigid plate 140 is positioned above the cantilever 130 such that a space or gap 151 exists between the rear surface 142 of the rigid plate 140 and the front surface 131 of the cantilever 130. Thus, as discussed above, the rigid plate 140 is isolated and separated from the cantilever 130 (and the handle 110) so as to form a completely separate component from the cantilever 130 (and the handle 110). The first resilient material 150 fills in the gap 151 between the rigid plate 140 and the cantilever 130 to flexibly couple the rigid plate 140 to the cantilever 130. Specifically, the first resilient material 150 flexibly couples a proximal portion 181 of the rigid plate 140 to the distal end 112 of the handle 110. The first resilient material 150 also flexibly couples a distal portion 182 of the rigid plate 140 to a distal end 137 of the cantilever 130. The resilient material 150 also encases and/or envelopes the transverse sides of the cantilever 130 to complete the resilient connection of the rigid plate 140 to the cantilever 130.

In the exemplified embodiment, the first resilient material 150 entirely fills the gap 151 between the rear surface 142 of the rigid plate 140 and the front surface 131 of the cantilever 130. However, the invention is not to be so limited in all embodiments and in certain other embodiments the first resilient material 150 merely provides a connection between the rigid plate 140 and the cantilever 130. In such embodiments, the first resilient material 150 extends from the sidewalls of the rigid plate 140 to the sidewalls of the cantilever 130 while leaving an air gap in between the rear surface 142 of the rigid plate 140 and the front surface 130 of the cantilever 130. In such embodiments, the rigid plate 140 remains separated from the cantilever 130 by a pivot structure 160, which will be described in detail below.

In certain embodiments, the first resilient material 150 is an injection molded thermoplastic elastomer. However, the invention is not to be so limited in all embodiments and the first resilient material 150 can be other materials that would facilitate pivoting of the rigid plate 140 relative to the cantilever 130 during use of the oral care implement 100 as will be discussed in more detail below. For example, the first resilient material 150 can be formed of other rubbers or elastomers including without limitation polybutadiene, chloroprene, butyl rubber, styrene-butadiene, styrene-ethylene/butylene-styrene block copolymer and the like.

The head 120 of the oral care implement 100 can be described in terms of layers in order to fully appreciate the structure thereof. Specifically, the cantilever 130 forms a rear longitudinal layer of the head 120 and the rigid plate 140 forms a front longitudinal layer of the head 120. Furthermore, the first resilient material 150 covers the rear surface 142 of the rigid plate 140 and the front surface 131 of the cantilever 130 thereby forming a middle longitudinal layer positioned between the front and rear longitudinal layers. In the exemplified embodiment, the resilient material 150 also covers the transverse shoulder 113 at the distal end 112 of the handle 110. The layering structure of the head 120 can best be seen in FIG. 4A.

The head 120 comprises a front surface 106 and a rear surface 107. The front surface 106 of the head 120 is coextensive with the front surface 141 of the rigid plate 140. The rear surface 107 of the head 120 is formed partially by the resilient material 150 and partially by the cantilever 130. Thus, the first resilient material 150 forms a first portion 107A of the rear surface 107 of the head 120 and the rear surface 132 of the cantilever 130 forms a second portion 107B of the rear surface 107 of the head 120. Thus, the first resilient material 150 and the rear surface 132 of the cantilever 130 combine to form the complete rear surface 107 of the head 120. This is due to the rigid plate 140 extending longitudinally beyond the cantilever 130 as will be described in more detail below.

As stated above, the first resilient material 150 covers the rear surface 142 of the rigid plate 140. In the exemplified embodiment, the first resilient material 150 covers the substantial entirety of the rear surface 142 of the rigid plate 140. However, in certain other embodiments portions of the rear surface 142 of the rigid plate 140 may be free of the first resilient material 150. For example, in certain embodiments the peripheral edge of the rear surface 142 of the rigid plate 140 may be free of the first resilient material 150 and in certain other embodiments the central region of the rear surface 142 of the rigid plate 140 may be free of the first resilient material 150, as has been discussed herein above.

As noted above, the head 120 also comprises the pivot structure 160 that protrudes from the front surface 131 of the cantilever 130. The pivot structure 160 comprises an upper portion 161 that extends upwardly from the cantilever 130 and into the space 151 between the rear surface 142 of the rigid plate 140 and the front surface 131 of the cantilever 130. Thus, due to its positioning in the space 151, the pivot structure 160 is completely encased in and surrounded by the first resilient material 150 in the exemplified embodiment. In the exemplified embodiment, the pivot structure 160 extends from the cantilever 130 so as to contact (i.e., surface contact) the rear surface 142 of the rigid plate 140. However, the invention is not to be so limited and in certain other embodiments a space may exist between the rear surface 142 of the rigid plate 140 and the pivot structure 160. In such embodiments, the space between the rear surface 142 of the rigid plate 140 and the pivot structure 160 may be filled with the first resilient material 150. As will be discussed in more detail below with reference to FIGS. 5A-5D, the rigid plate 140 pivots about the pivot structure 160 in response to brushing forces being applied to the head 120 of the oral care implement 100.

In the exemplified embodiment, the first resilient material 150 appears to be transparent so that the pivot structure 160 is visible from a side view of the head 120. However, the invention is not to be limited by the lucidity of the first resilient material 150 and in certain embodiments the first resilient material may be translucent or opaque.

In the exemplified embodiment the pivot structure 160 is a spheroid that is substantially spherical in shape having the upper portion 161 that extends into the gap 151 and forms a domed upper surface. However, the invention is not to be limited by the particular shape, size and configuration of the pivot structure 160 in all embodiments, and the pivot structure 160 may take on other spheroid-type shapes, such as for example without limitation an oblate spheroid, a prolate spheroid, an ellipsoid, an ovoid or any par- or truncated versions thereof. Thus, shapes other than those exemplified are contemplated for the pivot structure 160 of the present invention.

In certain embodiments, the pivot structure 160 is formed of a second resilient material. In some embodiments, the second resilient material is harder than the first resilient material 150. For example, the pivot structure 160 may be formed of a resilient material that has a greater Shore durometer value (e.g., Shore A hardness value) than the first resilient material 150 or vice versa. Furthermore, in certain other embodiments the second resilient material can be the same material as the first resilient material 150. Further still, in other embodiments the pivot structure 160 can be formed of a rigid material, such as any of the hard plastic materials discussed herein above or any other material that is more rigid than the first resilient material 150. Thus, the pivot structure 160 is not to be specifically limited by the resiliency of the material that forms the pivot structure 160 unless so specified in the claims.

With continued reference to FIGS. 3-4A, the connections and relative positioning between the cantilever 130, the pivot structure 160 and the rigid plate 140 will be described in more detail. The cantilever 130 comprises a cantilever socket 133 formed into the distal end 137 of the cantilever 130. The cantilever socket 133 comprises a floor 136 and an annular collar 134 that extends upwardly from the front surface 131 of the cantilever 130. A lower portion 162 of the pivot structure 160 (i.e., spheroid) is nested in the cantilever socket 133 and in the annular collar 134 of the cantilever socket 133. Thus, the cantilever socket 133 and annular collar 134 form a housing for the lower portion 162 of the pivot structure 160. In certain embodiments, the pivot structure 160 is located adjacent the distal end 137 of the cantilever 130.

Furthermore, as noted above in the exemplified embodiment the upper portion 161 of the pivot structure 160 is in surface contact with the rear surface 142 of the rigid plate 140. Thus, in order to accommodate the domed surface of the upper portion 161 of the pivot structure 160, the rear surface 142 of the rigid plate 140 comprises a plate socket 159. The upper portion 161 of the pivot structure 160 nests within the plate socket 159 formed into the rear surface 142 of the rigid plate 140. In embodiments wherein a space exists between the upper portion 161 of the pivot structure 160 and the rear surface 142 of the rigid plate 140 (and even in some embodiments that do not include such a space), the plate socket 159 may be omitted and the rear surface 142 of the rigid plate 140 may be a flat surface.

The cantilever 130 comprises a first transverse side 138 and an opposing second transverse side 139. The rigid plate 140 comprises a first transverse side 178 and an opposing second transverse side 179. The first transverse side 178 of the rigid plate 140 extends transversely beyond the first transverse side 138 of the cantilever 130. Similarly, the second transverse side 179 of the rigid plate 140 extends transversely beyond the second transverse side 139 of the cantilever 130. Thus, the rigid plate 140 has a transverse width that is greater than a transverse width of the cantilever 130.

Furthermore, the rigid plate 140 extends longitudinally beyond the distal end 137 of the cantilever 130. Specifically, the rigid plate 140 can be divided into the proximal portion 181, the distal portion 182 and a central portion 183 located between the proximal portion 181 and the distal portion 182. The central portion 183 of the rigid plate 140 is also located between the first and second transverse sides 178, 179 of the cantilever 130. The proximal portion 181 of the rigid plate 140 is positioned so as to oppose the cantilever 130. The central portion 183 of the rigid plate 140 is positioned so as to be in contact with (or to oppose in embodiments that do not have the relevant contact) the pivot structure 160. Furthermore, the distal portion 182 of the rigid plate 140 protrudes or extends longitudinally beyond the distal end 137 of the cantilever. Thus, in addition to being wider than the cantilever 130, the rigid plate 140 also has a longitudinal length that is greater than a longitudinal length of the cantilever 130.

Referring to FIGS. 5A-5D, the movement of the rigid plate 140 of the oral care implement 100 will be described. The rigid plate 140 is capable of pivoting about the pivot structure 160 in response to brushing forces being applied to the head 120 in various directions. More specifically, the rigid plate 140 is capable of 360 degree pivotal motion about the pivot structure 160 in response to the brushing forces being applied to the head. Furthermore, in certain embodiments in which the pivot structure 160 is omitted, the rigid head plate 140 may still be capable of movement depending on the hardness, thickness and density of the first resilient material 150.

Figure 5A:
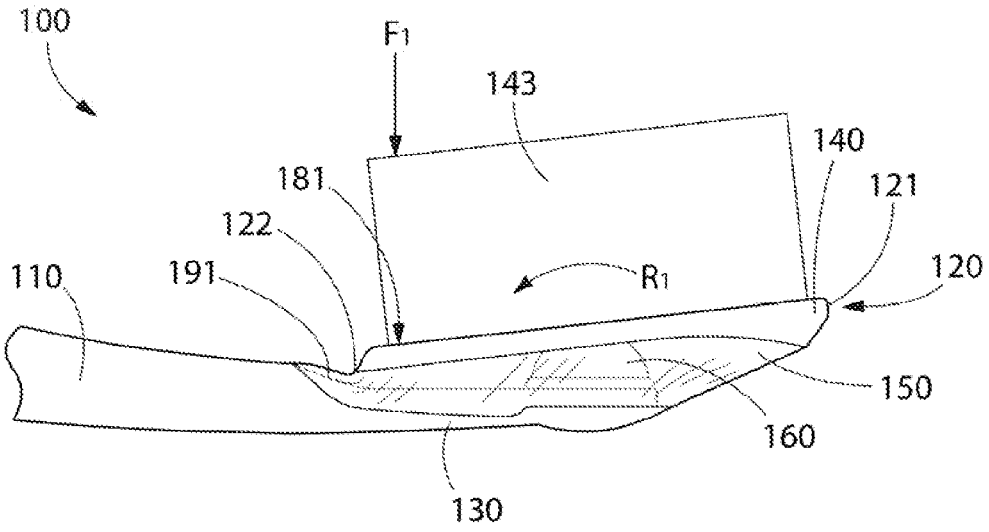
FIG. 5A the close-up view illustrated in FIG. 3, wherein the rigid plate of the head is pivoting in a longitudinal direction towards the handle.

Referring first to FIG. 5A, the oral care implement 100 is illustrated with a first brushing force $F_1$ being applied to the head 120 in the direction of the arrow. When the first brushing force $F_1$ is applied to the head 120, the rigid plate 140 pivots about the pivot structure 160 and relative to the cantilever 130 in the direction of rotation indicated by the arrow $R_1$. The first brushing force $F_1$ causes the rigid head 140 to pivot about the pivot structure 160 such that the proximal portion 181 of the rigid head 140 flexes downwardly in the direction of the cantilever 130. Specifically, upon application of the first brushing force $F_1$ to the head 120, a first portion 191 of the resilient material 150 located between the proximal portion 181 of the rigid head 140 and the distal end 112 of the handle 110 bends and/or flexes to facilitate movement of the rigid head 140. Movement of the rigid head 140 is restricted by the pivot structure 160 in that without the pivot structure 160, the rigid head 140 may merely translate downwardly in the direction towards the cantilever 130 in response to the first brushing force $F_1$. By incorporating the pivot structure 160, the rigid head 140 is able to pivot such that the tooth cleaning elements 143 are angled upwardly from the proximal edge 122 of the head 120 to the distal edge 121 of the head 120 in response to application of the first brushing force $F_1$ to the head 120.

Figure 5B:
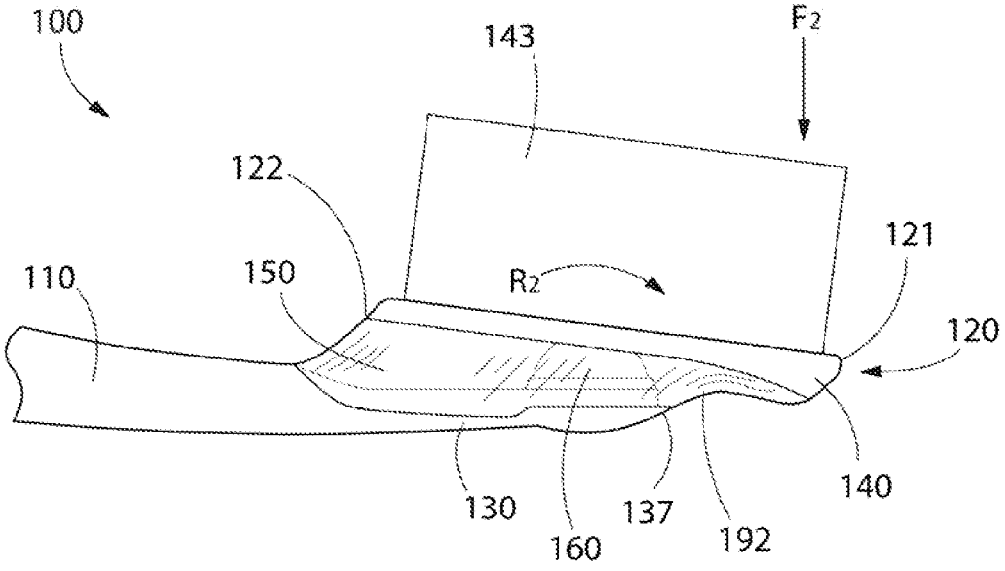
FIG. 5B is the close-up view illustrated in FIG. 3, wherein the rigid plate of the head is pivoting in a longitudinal direction away the handle.

Referring to FIG. 5B, the oral care implement 100 is illustrated with a second brushing force $F_2$ being applied to the head 120 in the direction of the arrow. When the second brushing force $F_2$ is applied to the head 120, the rigid plate 140 pivots about the pivot structure 160 and relative to the cantilever 130 in the direction of rotation indicated by the arrow $R_2$. The second brushing force $F_2$ causes the rigid head 140 to pivot about the pivot structure 160 such that the distal portion 182 of the rigid head 140 flexes downwardly in the direction of the cantilever 130. Specifically, upon application of the second brushing force $F_2$ to the head 120, a second portion 192 of the resilient material 150 located between the distal portion 182 of the rigid head 140 and the distal end 137 of the cantilever 130 bends and/or flexes to facilitate movement of the rigid head 140. Movement of the rigid head 140 is restricted by the pivot structure 160 in that without the pivot structure 160, the rigid head 140 may merely translate downwardly in the direction towards the cantilever 130 in response to the second brushing force $F_2$. By incorporating the pivot structure 160, the rigid head 140 is able to pivot such that the tooth cleaning elements 143 are angled downwardly from the proximal edge 122 of the head 120 to the distal edge 121 of the head 120 in response to application of the second brushing force $F_2$ to the head 120.

Figure 5C:
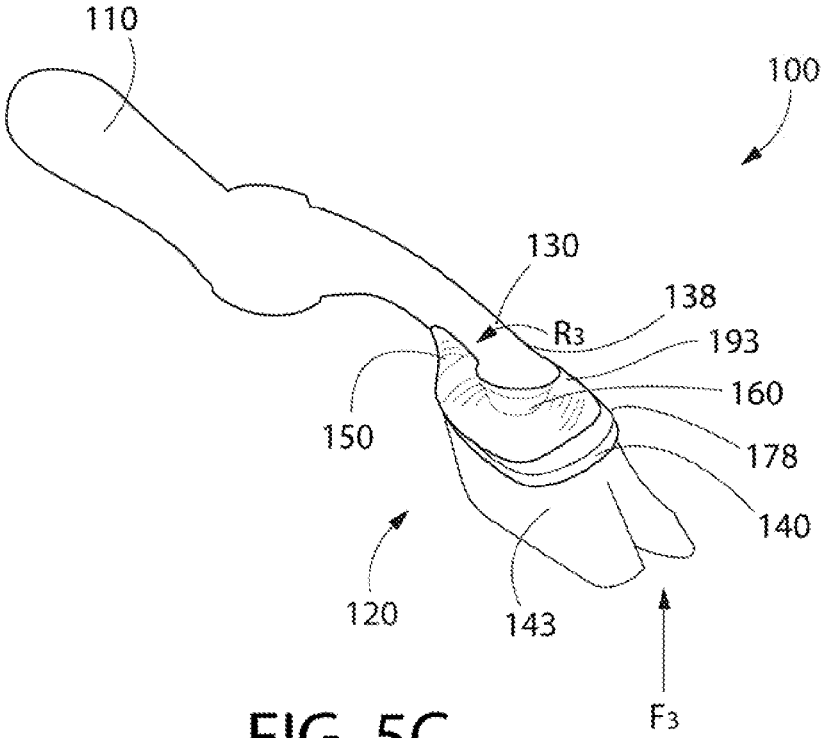
FIG. 5C is the close-up view illustrated in FIG. 3, wherein the rigid plate of the head is pivoting in a first transverse direction.

Referring to FIG. 5C, the oral care implement 100 is illustrated with a third brushing force $F_3$ being applied to the head 120 in the direction of the arrow. When the third brushing force $F_3$ is applied to the head 120, the rigid plate 140 pivots about the pivot structure 160 and relative to the cantilever 130 in the direction of rotation indicated by the arrow $R_3$. The third brushing force $F_3$ causes the rigid head 140 to pivot about the pivot structure 160 such that the first transverse side 178 of the rigid head 140 flexes downwardly in the direction of the cantilever 130. Specifically, upon application of the third brushing force $F_3$ to the head 120, a third portion 193 of the resilient material 150 located between the first transverse side 178 of the rigid head 140 and the first transverse side 138 of the cantilever 130 bends and/or flexes to facilitate movement of the rigid head 140. Movement of the rigid head 140 is restricted by the pivot structure 160 in that without the pivot structure 160, the rigid head 140 may merely translate downwardly in the direction towards the cantilever 130 in response to the third brushing force $F_3$. By incorporating the pivot structure 160, the rigid head 140 is able to pivot such that that tooth cleaning elements 143 are angled as illustrated in FIG. 5C in response to application of the third brushing force $F_3$ to the head 120.

Figure 5D:
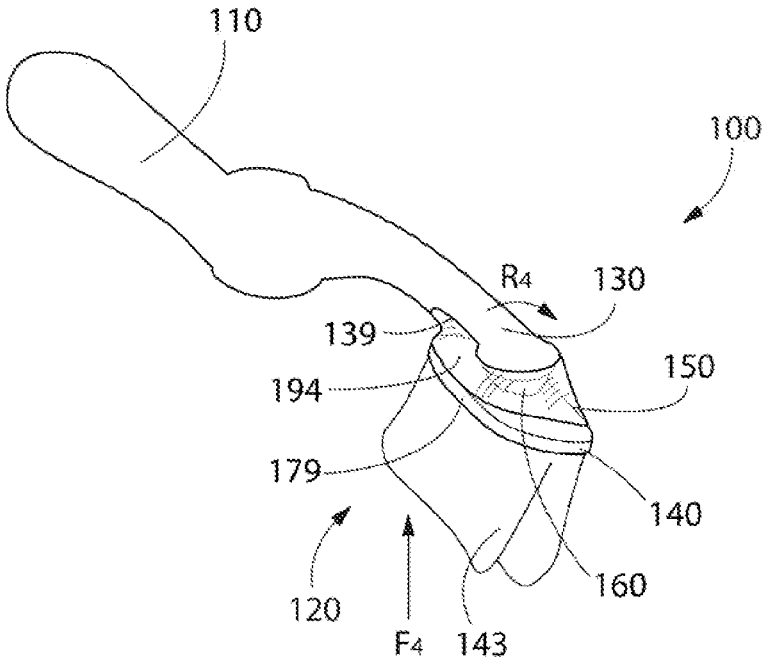
FIG. 5D is the close-up view illustrated in FIG. 3, wherein the rigid plate of the head is pivoting in a second transverse direction.

Referring to FIG. 5D, the oral care implement 100 is illustrated with a fourth brushing force $F_4$ being applied to the head 120 in the direction of the arrow. When the fourth brushing force $F_4$ is applied to the head 120, the rigid plate 140 pivots about the pivot structure 160 and relative to the cantilever 130 in the direction of rotation indicated by the arrow $R_4$. The fourth brushing force $F_4$ causes the rigid head 140 to pivot about the pivot structure 160 such that the second transverse side 179 of the rigid head 140 flexes downwardly in the direction of the cantilever 130. Specifically, upon application of the fourth brushing force $F_4$ to the head 120, a fourth portion 194 of the resilient material 150 located between the second transverse side 179 of the rigid head 140 and the second transverse side 139 of the cantilever 130 bends and/or flexes to facilitate movement of the rigid head 140. Movement of the rigid head 140 is restricted by the pivot structure 160 in that without the pivot structure 160, the rigid head 140 may merely translate downwardly in the direction towards the cantilever 130 in response to the fourth brushing force $F_4$. By incorporating the pivot structure 160, the rigid head 140 is able to pivot such that that tooth cleaning elements 143 are angled as illustrated in FIG. 5D in response to application of the fourth brushing force $F_4$ to the head 120.

In addition to the movement of the rigid plate 140 described above, in embodiments wherein the pivot structure 160 is formed of a resilient material, the rigid plate 140 may also translate downwardly in the direction of the cantilever 130 in response to any of the brushing forces described above. Furthermore, brushing forces other than those described herein can be applied to the head 120, and each brushing force will cause the rigid plate 140 to pivot in a different direction. Thus, as described above, the rigid head 140 is capable of 360 degree pivotal motion in response to brushing forces being applied to the head. Thus, the oral care implement 100 results in a flexible head toothbrush that can pivot in all directions to better brush the teeth, gums and crevices between the teeth as desired.

Figure 6:
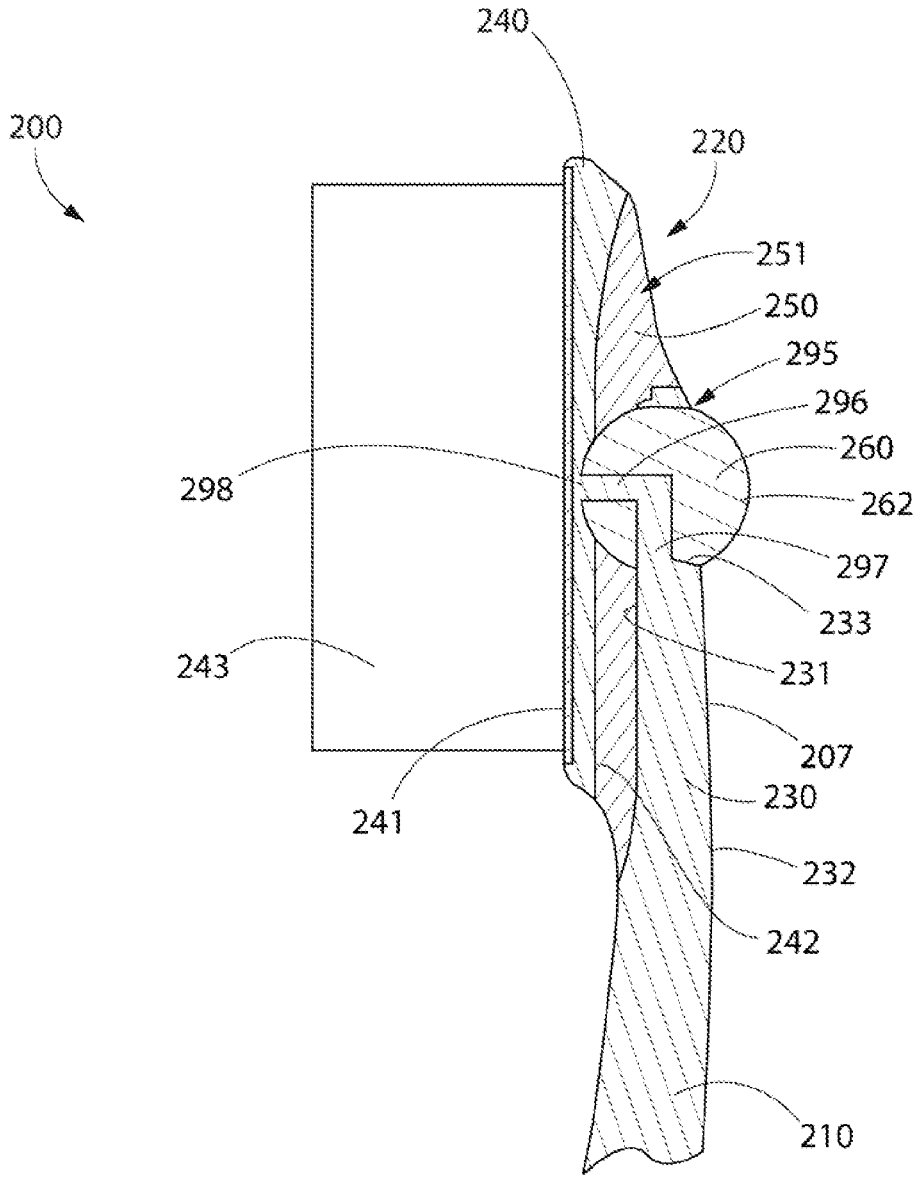
FIG. 6 is a cross-sectional view of a head and a distal end of a handle of an oral care implement in accordance with a second embodiment of the present invention.

Turning to FIG. 6, an oral care implement 200 in accordance with a second embodiment of the present invention will be described. The oral care implement 200 is similar to the oral care implement 100 in many regards. Thus, in the interest of brevity descriptions of components that have been described above with regard to the oral care implement 100 will not be repeated with regard to the oral care implement 200. Furthermore, similar components will be similarly numbered except that the 200-series of numbers will be used. Structural details, materials and configurations of the components of the oral care implement 100 described above are equally applicable to the oral care implement 200 unless otherwise specified.

The oral care implement 200 generally comprises a handle 210 and a head 220. The head comprises a cantilever 230, a rigid plate 240, a first resilient material 250 and a pivot structure 260 (i.e., spheroid). A plurality of tooth cleaning elements 243 extend outwardly from a front surface 241 of the rigid plate 240. Furthermore, a rear surface 242 of the rigid plate 240 is spaced from a front surface 231 of the cantilever 230 forming a gap 251 therebetween. The gap 251 is filled with the first resilient material 250 in the manner that has been described above with regard to the oral care implement 100. Thus, the oral care implement 200 is capable of 360 degree pivotal motion about the pivot structure 160 in response to brushing forces being applied to the head 220 in the same manner as has been described above.

The cantilever 230 comprises a cantilever socket 233 within which a portion of the pivot structure 260 nests. Furthermore, the cantilever socket 233 comprises an annular collar 234. In the oral care implement 200, the cantilever 230 further comprises a passageway 295 through the annular collar 234 from the front surface 231 of the cantilever 230 to a rear surface 232 of the cantilever 230. A lower portion 262 of the pivot structure 260 extends through the passageway 295 and is exposed on a rear surface 207 of the head 220.

Furthermore, the oral care implement 200 comprises a post 296 that extends through the pivot structure 260. The post 296 has a first end 297 that is connected to the cantilever 230 and a second end 298 that is connected to the rigid plate 240. The post 296 provides a stable connection point between the cantilever 230 and the rigid plate 240. In the exemplified embodiment, the cantilever 230, the post 296 and the rigid plate 240 are integrally formed of a hard plastic material. However, the invention is not to be so limited in all embodiments and in certain other embodiments each of the cantilever 230, the post 296 and the rigid plate 240 can be separately formed and connected together at a later stage in the manufacturing process.

In certain other embodiments the post 296 may form a portion of the pivot structure 260. In such embodiments, the post 296 may provide a rigid connection point between the pivot structure 260 and the rigid plate 240. The post 296 comprises a small cross-sectional area so that the post 296 does not limit or otherwise affect the ability of the rigid plate 240 to pivot relative to the cantilever 230 as has been described herein in detail.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An oral care implement comprising:

a handle extending along a longitudinal axis from a proximal end to a distal end;

a head comprising:

a cantilever connected to and extending longitudinally from the distal end of the handle;

a spheroid protruding from a front surface of the cantilever;

a rigid plate having a front surface and a rear surface, the rigid plate positioned above the cantilever so that the rigid plate is spaced from the cantilever by a gap; and a first resilient material in the gap flexibly coupling the rigid plate to the cantilever, the first resilient material encasing the spheroid and covering the rear surface of the rigid plate and the front surface of the cantilever;

a plurality of teeth cleaning elements coupled to and extending from the front surface of the rigid plate; and the rigid plate pivoting about the spheroid in response to a force being applied to the head, wherein the rigid plate is capable of 360 degree pivotal motion about the spheroid in response to the brushing forces being applied to the head.

2. The oral care implement according to claim 1 wherein the spheroid contacts the rear surface of the rigid plate.

3. The oral care implement according to claim 1 wherein the cantilever and the handle are integrally formed of a rigid material.

4. The oral care implement according to claim 1 wherein the cantilever comprises a cantilever socket, a lower portion of the spheroid nested in the cantilever socket.

5. The oral care implement according to claim 4 wherein the cantilever socket comprises an annular collar, the lower portion of the spheroid nested in the annular collar.

6. The oral care implement according to claim 5 wherein the cantilever socket further comprises a floor.

7. The oral care implement according to claim 4 wherein the cantilever comprises a passageway through the annular collar extending from the front surface of the cantilever to a rear surface of the cantilever, the lower portion of the spheroid exposed on a rear surface of the head.

8. The oral care implement according to claim 1 wherein the first resilient material flexibly couples a proximal portion of the rigid plate to the distal end of the handle.

9. The oral care implement according to claim 1 wherein the spheroid comprises a domed surface in contact with the rear surface of the rigid plate.

10. The oral care implement according to claim 1 wherein the rigid plate extends transversely beyond first and second transverse sides of the cantilever.

11. The oral care implement according to claim 1 wherein the rigid plate comprises a distal portion, a proximal portion, and a central portion located between the distal portion and the proximal portion, the distal portion of the rigid plate protruding longitudinally beyond a distal end of the cantilever, the proximal portion of the rigid plate opposing the cantilever, and the central portion of the rigid plate in contact with the spheroid.

12. The oral care implement according to claim 11 wherein the rigid plate comprises a first transverse side portion and a second transverse side portion, the central portion located between the first and second transverse side portions, and wherein the first and second transverse side portions of the rigid plate protrude transversely beyond first and second transverse sides of the cantilever.

13. The oral care implement according to claim 1 wherein the spheroid is located adjacent a distal end of the cantilever.

14. The oral care implement according to claim 1 wherein the spheroid is formed of a rigid material.

15. The oral care implement according to claim 1 wherein the rigid plate extends from a distal edge of the head to a proximal edge of the head.

16. The oral care implement according to claim 15 wherein a peripheral edge of the rigid plate forms a peripheral edge of the head.

17. The oral care implement according to claim 1 wherein the first resilient material forms a first portion of the rear surface of the head and a rear surface of the cantilever forms a second portion of the rear surface of the head.

18. The oral care implement according to claim 1 wherein the rigid plate comprises: a base plate having a front surface with a basin formed therein; and a head plate positioned in the basin, the plurality of teeth cleaning elements coupled to the head plate.

19. The oral care implement according to claim 1 further comprising a post extending through the spheroid, the post having a first end connected to the cantilever and a second end connected to the rigid plate.

20. The oral care implement according to claim 1 wherein the distal end of the handle comprises a transverse shoulder, the cantilever extending from the transverse shoulder.

21. The oral care implement according to claim 20 wherein the first resilient material covers the transverse shoulder.

22. An oral care implement comprising:

a handle extending along a longitudinal axis from a proximal end to a distal end;

a head comprising:

a cantilever connected to and extending longitudinally from the distal end of the handle;

a spheroid protruding from a front surface of the cantilever;

a rigid plate having a front surface and a rear surface, the rigid plate positioned above the cantilever so that the rigid plate is spaced from the cantilever by a gap, a plate socket formed in the rear surface of the rigid plate, an upper portion of the spheroid nested in the plate socket; and a first resilient material in the gap flexibly coupling the rigid plate to the cantilever, the first resilient material encasing the spheroid and covering the rear surface of the rigid plate and the front surface of the cantilever;

a plurality of teeth cleaning elements coupled to and extending from the front surface of the rigid plate; and the rigid plate pivoting about the spheroid in response to a force being applied to the head.

23. An oral care implement comprising:

a handle extending along a longitudinal axis from a proximal end to a distal end;

a head comprising:

a cantilever connected to and extending longitudinally from the distal end of the handle;

a spheroid protruding from a front surface of the cantilever;

a rigid plate having a front surface and a rear surface, the rigid plate positioned above the cantilever so that the rigid plate is spaced from the cantilever by a gap; and a first resilient material in the gap flexibly coupling the rigid plate to the cantilever, the first resilient material encasing the spheroid and covering the rear surface of the rigid plate and the front surface of the cantilever;

a plurality of teeth cleaning elements coupled to and extending from the front surface of the rigid plate;

the rigid plate pivoting about the spheroid in response to a force being applied to the head; and wherein the rigid plate extends longitudinally beyond a distal end of the cantilever.

24. An oral care implement comprising:

a handle extending along a longitudinal axis from a proximal end to a distal end;

a head comprising:

a cantilever connected to and extending longitudinally from the distal end of the handle;

a spheroid protruding from a front surface of the cantilever;

a rigid plate having a front surface and a rear surface, the rigid plate positioned above the cantilever so that the rigid plate is spaced from the cantilever by a gap; and a first resilient material in the gap flexibly coupling the rigid plate to the cantilever, the first resilient material encasing the spheroid and covering the rear surface of the rigid plate and the front surface of the cantilever;

a plurality of teeth cleaning elements coupled to and extending from the front surface of the rigid plate;

the rigid plate pivoting about the spheroid in response to a force being applied to the head; and wherein the spheroid is formed of a second resilient material.

25. The oral care implement according to claim 24 wherein the second resilient material is harder than the first resilient material.

26. An oral care implement comprising:

a handle extending along a longitudinal axis from a proximal end to a distal end;

a head comprising:

a cantilever extending longitudinally from the distal end of the handle;

a pivot structure protruding from a front surface of the cantilever;

a rigid plate having a front surface and a rear surface, the rigid plate positioned above the cantilever so that the rigid plate is spaced from the cantilever by a gap, the rigid plate extending longitudinally beyond a distal end of the cantilever; and a first resilient material in the gap, wherein the first resilient material fills in the gap between the rigid plate and the cantilever, flexibly coupling the rigid plate to the cantilever, the first resilient material encasing the pivot structure and covering the rear surface of the rigid plate and the front surface of the cantilever;

a plurality of teeth cleaning elements coupled to and extending from the front surface of the rigid plate;

the rigid plate pivoting relative to the cantilever about the pivot structure in response to brushing forces being applied to the head; and wherein the rigid plate extends transversely beyond first and second transverse sides of the cantilever.

27. The oral care implement according to claim 26 wherein the cantilever is integral with the handle.

28. The oral care implement according to claim 26 wherein the distal end of the handle comprises a transverse shoulder, the cantilever extending from the transverse shoulder.

29. The oral care implement according to claim 28 wherein the first resilient material covers the transverse shoulder.

30. The oral care implement according to claim 26 wherein the rigid plate comprises a distal portion, a proximal portion, and a central portion located between the distal and proximal portions, the distal portion of the rigid plate protruding longitudinally beyond a distal end of the cantilever and the proximal portion of the rigid plate opposing the cantilever, the central portion of the rigid plate in contact with the pivot structure.

31. The oral care implement according to claim 30 wherein the rigid plate comprises a first transverse side portion and a second transverse side portion, the central portion located between the first and second transverse side portions, and wherein the first and second transverse side portions of the rigid plate protrude transversely beyond first and second transverse sides of the cantilever.

32. The oral care implement according to claim 26 wherein the pivot structure is located adjacent a distal end of the cantilever.

33. The oral care implement according to claim 26 wherein the pivot structure is formed of a second resilient material that is harder than the first resilient material.

34. The oral care implement according to claim 26 wherein a peripheral edge of the rigid plate forms a peripheral edge of the head.

35. The oral care implement according to claim 26 wherein the first resilient material forms a first portion of the rear surface of the head and a rear surface of the cantilever forms a second portion of the rear surface of the head.

36. An oral care implement comprising:

a handle extending along a longitudinal axis from a proximal end to a distal end;

a head comprising:

a cantilever extending longitudinally from the distal end of the handle and forming a rear longitudinal layer of the head;

a rigid plate having a front surface and a rear surface, the rigid plate positioned above the cantilever so that the rigid plate is spaced from the cantilever by a gap, the rigid plate forming a front longitudinal layer of the head; and a first resilient material in the gap flexibly coupling the rigid plate to the cantilever, the first resilient material covering the rear surface of the rigid plate and a front surface of the cantilever, the first resilient material forming a middle longitudinal layer between the front and rear longitudinal layers;

a plurality of teeth cleaning elements coupled to and extending from the front surface of the rigid plate;

wherein the first resilient material forms a first portion of a rear surface of the head and a rear surface of the cantilever forms a second portion of the rear surface of the head.

37. The oral care implement according to claim 36 further comprising a pivot structure encased in the middle longitudinal layer, the rigid plate pivoting about the pivot structure in response to forces being applied to the head.

38. The oral care implement according to claim 37 wherein the pivot structure protrudes from a front surface of the cantilever and contacts the rear surface of the rigid plate.

39. The oral care implement according to claim 36 wherein the cantilever is integral with the handle.

40. The oral care implement according to claim 36 wherein the distal end of the handle comprises a transverse shoulder, the cantilever extending from the transverse shoulder.

41. The oral care implement according to claim 36 wherein the rigid plate extends from a distal edge of the head to a proximal edge of the head.

42. The oral care implement according to claim 36 wherein the rigid plate extends transversely beyond first and second transverse sides of the cantilever.

43. The oral care implement according to claim 36 wherein a peripheral edge of the rigid plate forms a peripheral edge of the head.

* * * * *